US005829189A

United States Patent [19]

Grigsby, Sr.

[11] Patent Number: 5,829,189

[45] Date of Patent: Nov. 3, 1998

[54] HINGED-CORNERS UNITARY BODY FOR WOOD CLEATED CRATE

[75] Inventor: John M. Grigsby, Sr., Marietta, Ga.

[73] Assignee: North American Container Corp., Mableton, Ga.

[21] Appl. No.: 926,122

[22] Filed: Sep. 9, 1997

[51] Int. Cl.[6] ..... B65D 6/28

[52] U.S. Cl. ..... 217/48; 217/16

[58] Field of Search ..... 217/13, 14, 15, 217/48, 45

[56] References Cited

U.S. PATENT DOCUMENTS

| | | | |
|---|---|---|---|
| 939,026 | 11/1909 | Howland . | |
| 1,787,305 | 12/1930 | Campbell . | |
| 1,895,624 | 1/1933 | Hingston . | |
| 2,042,323 | 5/1936 | Ott | 217/16 |
| 2,110,150 | 3/1938 | Hile | 217/16 |
| 2,141,497 | 12/1938 | Watkins | 217/48 |
| 2,159,642 | 5/1939 | Watkins | 217/48 |
| 2,316,854 | 4/1943 | George et al. | 217/13 |
| 2,317,613 | 4/1943 | Hull et al. | 217/36 |
| 2,488,692 | 11/1949 | Talbot | 217/12 |
| 2,525,838 | 10/1950 | Smith et al. | 217/16 |
| 2,609,957 | 9/1952 | Sester | 217/48 |
| 2,672,252 | 3/1954 | Frear | 217/48 |
| 2,799,420 | 7/1957 | Dedmon | 217/48 |
| 2,808,956 | 10/1957 | Johnson | 217/48 |
| 3,451,578 | 6/1969 | Edmundson | 217/48 |
| 3,874,543 | 4/1975 | Farnsworth | 217/48 |
| 4,120,417 | 10/1978 | Aquino | 220/6 |
| 4,383,609 | 5/1983 | Lochmiller | 206/386 |
| 4,832,256 | 5/1989 | Grigsby | 229/23 C |

FOREIGN PATENT DOCUMENTS

| | | |
|---|---|---|
| 500520 | 3/1954 | Canada . |
| 544415 | 8/1967 | Canada . |
| 311983 | 5/1929 | United Kingdom . |

*Primary Examiner*—Joseph M. Moy
*Attorney, Agent, or Firm*—Kennedy, Davis & Kennedy

[57] ABSTRACT

A hinged-corners unitary collapsible wood cleated crate for packaging heavy goods with a tubular body engaged to a base and top frame. The tubular body is formed of a pair of opposing side frames and a pair of opposing end frames, which frames each have a pair of horizontal rails connected to a pair of vertical side slats at respective overlapping aligned distal ends. Each frame includes at least one diagonal cross-member extending between and attached to the pair of horizontal rails. The side frames and the end frames join together in alternating spaced-apart sequence by a plurality of hinge plates that interconnect one of the pair of vertical slats in one of the side frames with one of the pair of vertical slats in an adjacent end frame. The hinge plates are planar sheets of a weather-resistant material, which are scored to allow the tubular body to knock-down for storage and shipping, and unfold to form a volumed body for packaging heavy goods held on a base. The body receives a top frame, and staples secure the body to the base and the top frame.

3 Claims, 2 Drawing Sheets

HINGED-CORNERS UNITARY BODY FOR WOOD CLEATED CRATE

TECHNICAL FIELD

The present invention relates generally to crates for packing heavy goods. More particularly, the present invention relates to wood cleated crates for packaging heavy goods for long term outdoor storage, as well as for handling and shipping such heavy goods.

BACKGROUND OF THE INVENTION

Heavy durable goods, such as riding lawn mowers, outboard motors and the like, are routinely packaged in containers for handling, storage, and shipping. One type of container for storing and shipping such heavy articles is wood cleated crates. Such wood cleated crates have been used for long term outside storage by manufacturers of such heavy articles. Generally, wood cleated crates are relatively inexpensive and maintain strength and integrity even when stored in outside weather conditions.

Conventional wood cleated crates for packaging such articles typically are comprised of separate loose sides, ends, tops, and bases. These components are known in the trade as "crate shook". Two sides and two ends are used together with a base and a top for assembly of a wood cleated crate. These separate components are stapled or nailed together at the user's assembly lines during packaging of the heavy goods manufactured by the user of the crates. The nailing and stapling however requires much assembly line labor, fasteners, and time. The assembly line continues to produce heavy articles for packaging. The crating line personnel must keep up with the assembly line to prevent backups or being overwhelmed with the products coming from the assembly line.

These demands can lead to problems with the consistency of assembly of these crate shook components. Consistency of assembly is highly dependent on the ability of crating line personnel to quickly align edges of the components and to use conventional hand-held air staple guns to connect the components together. The staple guns drive the nails or staples through the cleats in the crate shook in order to join the sides, ends, tops, and bases together. The shook crate components also dry after manufacture, which leads to warping and twisting of the components. These distortions make aligning and hand stapling of the ends and sides difficult.

Various crates have been proposed to overcome the need to assemble crate shook during packaging. One such type of container is known as wire bound wood crates. Strands of steel wire are stapled girthwise to faces of the sides and the ends which are positioned side-by-side. The strands of wire join the sides and ends together and the assembly forms a "mat" comprised of two opposing sides and two ends arranged in alternating sequence. Typically, there are five to seven strands of wires which extend the full length horizontally across the two sides and two ends. Staples attach the wires to the crate shook.

The wire strands form "hinges" across the adjacent sides and ends of the crate shook. The hinges permit the mat to fold or wrap around the base which supports the heavy article to be packaged. The final joint or corner is connected during packaging by hand-stapling the adjacent edges of the side and end or by being tied with wire twists. The wood top frame is then set in place and stapled to the crate.

While wire bound wood crates minimize the stapling required to assemble the crate on the packaging line, there are disadvantages involved with using such wire bound wood crates. These disadvantages particularly arise from the use of the wires for binding the crate shook and of the staples to secure the wires for forming the mat. The wires are long. These wires interfere with disposal and recycling efforts. Continuous wire strands are used rather than having discrete short length wires to join the adjacent sides and ends together, which would be more labor intensive to manufacture. It is difficult and extremely impractical to extract the hundreds of staples which secure the wires to the crate shook, in order to dispose of the wood components after the crate has served its purpose and is ready for disposal. Further, the wires make grinding of the wood components impractical. Such wire bound crates accordingly must be burned or placed in landfills for disposal. Such disposal techniques are no longer environmentally satisfactory.

The wire bound crate is also difficult to handle while packaging. The crates are shipped from the manufacturer to the user as long mats. The long mats take up significant space in warehouses and crate delivery trucks, which increase costs associated with packaging heavy goods. Each mat is manually folded around the base during packaging. Manual handling of the extended mats is difficult and awkward. Further, the wire-tied corners that define the hinges are typically stiff and difficult to fold into squared-up corners. The resulting crate, having mis-alignments or angled components, may cause stacks of such crates to lean or even to fall.

Crates for such heavy durable goods must have strong tensile strength in order to permit stacked shipment and storage of the goods packaged in the creates. In stacked shipments, the upper units in the stacks exert large "racking" forces on the lower units due to the momentum of the upper units as the truck trailers or rail cars change velocity, stop and start. These racking forces tend to loosen the staples applied to the corners of these crates. The loosened staples reduce the rigidity of the crate and may cause the crate to collapse, causing damage to the product contained therein and may result in injury or safety hazards to persons nearby.

Accordingly, there remains a need in the art for cleated crates which are free of such disadvantages while providing a wood cleated crate for packaging heavy goods on assembly lines. It is to the provision of such that the present invention is directed.

SUMMARY OF THE PRESENT INVENTION

The present invention solves the need in the art by providing an improved hinged-corners unitary wood cleated crate for packaging heavy articles, comprising a unitary wood cleated body defined by a pair of opposing side frames and a pair of opposing end frames. Each side frame and end frame comprises a pair of parallel spaced-apart horizontal rails which define a lower edge and an upper edge of the body, a pair of parallel spaced-apart vertical slats, which rails and slats are joined rigidly together at respective overlapping aligned distal ends. Each of the frames also includes at least one diagonal cross-member that extends at an oblique angle between the pair of horizontal rails and is attached at distal ends thereto.

The side frames and the end frames join together in alternating spaced-apart sequence by a plurality of hinge plates. Each hinge plate interconnects one of the pair of vertical slats in one of the side frames with one of the pair of vertical slats in an adjacent end frame. Each of the hinge plates is defined by a planar sheet of a weather-resistant material, such as solid fibre paperboard or a plastics corrugated sheet material. The sheet has a longitudinal axis. A pair of panels in the sheet are defined by a score parallel to the longitudinal axis. Each of the pair of panels in the sheet rigidly attaches to a respective one of the vertical slats in the adjacent side and end frames. The hinge plates extend substantially the length of the vertical slats between the pair of horizontal rails.

The pairs of the side frames and the end frames, being joined together by the hinge plates, defines a unitary wood cleated crate body that foldingly collapses on the scores to a substantially flat knock-down position for storage and shipping from a manufacturer of the crate to a user for packaging heavy goods therein upon unfolding along the scores to define a volumed unitary crate body having squared-corners for engaging a base that contains a heavy good to be packaged therein.

Other objects, features and advantages of the present invention will become apparent upon reading the following detailed description of the disclosed embodiment of the present invention, in conjunction with the appended drawings and claims.

DETAILED DESCRIPTION OF THE PREFERRED EMBODIMENTS

Figure 1:
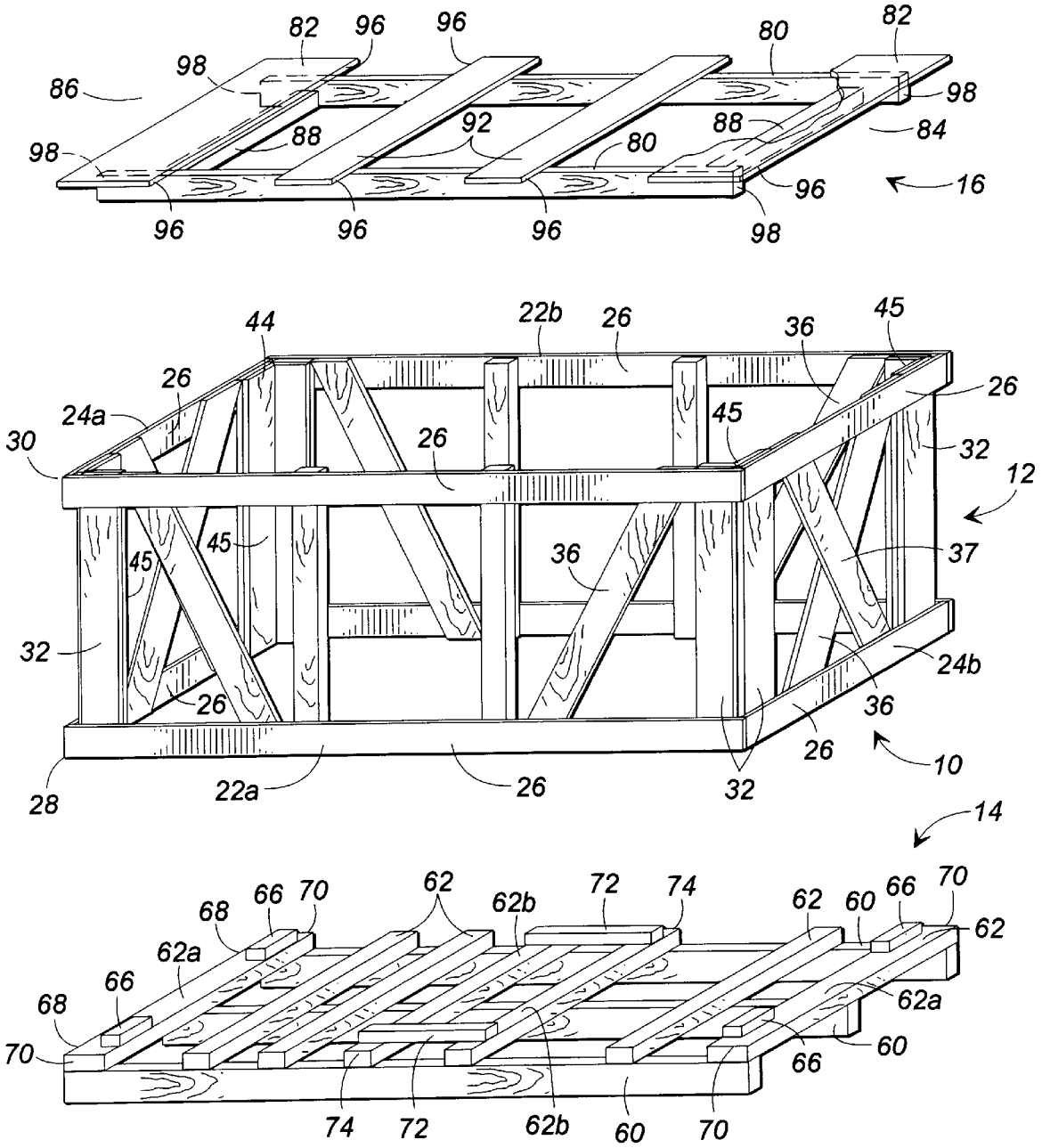
FIG. 1 is a perspective view of a crate having a hinged-corners unitary wood cleated body in accordance with a preferred embodiment of the present invention, with a base and a top frame exploded therefrom.
Figure 3:
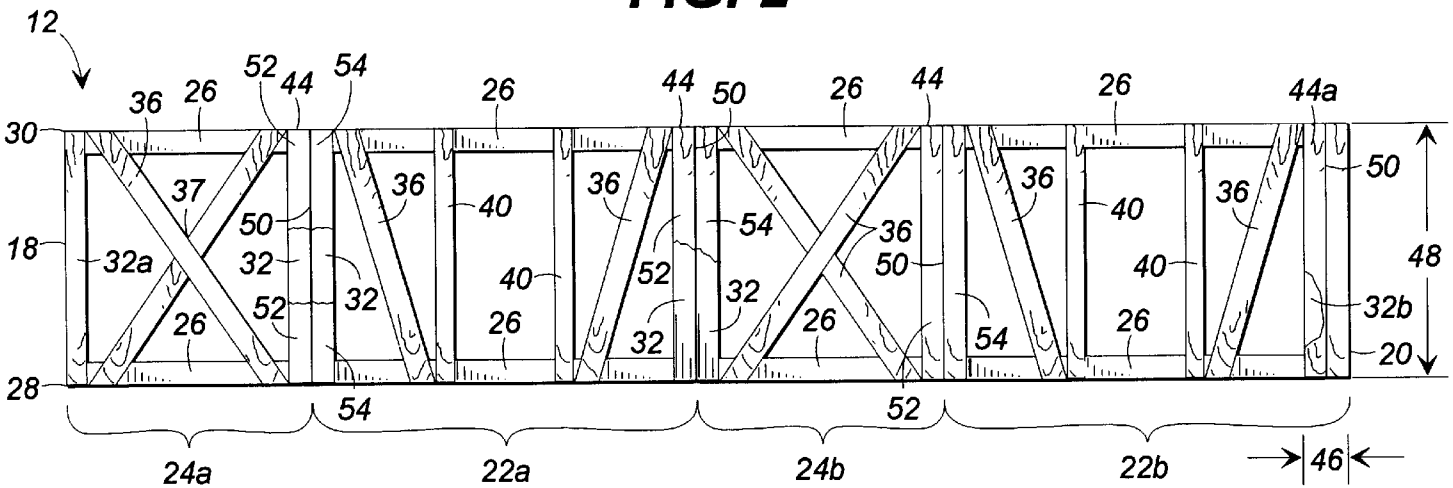
FIG. 3 is a plan view of a layout of the wood cleated body for the hinged-corners unitary wood cleated crate illustrated in FIG. 1.

Referring now in more detail to the drawings in which like parts have like identifiers, FIG. 1 is a perspective view of a preferred embodiment of a hinged-corners unitary wood cleated crate 10 in accordance with a preferred embodiment of the present invention. The crate 10 comprises a tubular wood cleated body 12 having a base 14 and a top frame 16. FIG. 3 illustrates a plan view of a layout for the hinged-corners unitary wood cleated body 12, prior to joining of a first distal end 18 with a second distal end 20 to form the tubular body 12. With continuing reference to FIGS. 1 and 3, the tubular body 12 comprises a pair of opposing side frames 22*a*, 22*b* and a pair of opposing end frames 24*a*, 24*b*. Each of the side frames 22 and the end frames 24 comprises a pair of parallel spaced-apart horizontal rails 26 which define a lower edge 28 and an upper edge 30 of the tubular body 12. The rails 26 for the end frames 24 are typically of a shorter, different length than the length of the rails 26 for the side frames 22. In a square crate, the rails 26 are substantially the same length in both the side and end frames 22, 24.

A pair of parallel spaced-apart vertical slats 32 attach at distal ends 34 to the rails 26. Each of the frames 22 and 24 also have at least one diagonal cross-member 36 which extends at an oblique angle between the pair of horizontal rails 26. The cross-member 36 rigidly attaches at distal ends 38 to the respective rails 26 adjacent the connection with the vertical slats 32. In the illustrated embodiment, the opposing end frames 24 include a pair of cross members 36 which overlap at 37. In the illustrated embodiment, the opposing side frames 22 each include a pair of the cross members 36 which are spaced-apart and attached to the rails 26 near the distal ends of the side frames 22. The side frames 22 also include a pair of central vertical slats 40. The rails 26, slats 32 and 40, and cross-members 36 are joined together with staples. In the illustrated embodiment, the slats 32 have a ½ inch thickness and a 2¾ inch width. The slats 32 and the rails 26 are preferably joined with ½ inch by 1¼ inch clinched staples The pairs of the side frames 22 and the end frames 24 align in alternating sequence, as illustrated in FIG. 3. The adjacent side frames 22 and the end frames 24 join together by a plurality of hinge plates 44 which defines hinged-corners 45 in the body 12, as illustrated in perspective detailed view in FIG. 2. The panels 52, 54 in the hinge plates 44 connect to the slats 32 in the adjacent side and end frames 22, 24. For example, the hinge plate 44*a* attaches to the vertical slat 32*a*in the end frame 24*a* with the vertical slat 32*b* the side frame 22*b* when the hinge plates 44 are folded on the scores 50, as discussed below, to form the tubular body 12. The hinge plates 44 accordingly interconnect the side frames 22 to the adjacent end frames 24.

Each of the hinge plates 44 is defined by a planar sheet of a weather-resistant material. The hinge plate 44 has a width 46 that is substantially equal to the width of two of the vertical slats 32. The hinge plate 44 has a length 48 substantially the length of the vertical slats 32. The hinge plate 44 defines a crease or score 50 along a longitudinal axis. The score 50 defines a pair of panels 52, 54. One of the panels 52, 54 rigidly attaches to a respective one of the vertical slats 32 in the adjacent side frames 22 and end frames 24. The hinge plate 44 rigidly connects to the slats 32 with glue 55 and staples 57. The sheet material for forming the hinge plates 44 preferably has high tensile strength. Inexpensive sheet materials include solid fibre paperboard preferably having a thickness of 0.09 or 0.12 inches (which is known as 90 point or 120 point solid fibre) and plastic corrugated sheets.

With reference to FIG. 1, the base 14 for use with the hinged-corners unitary wood cleated body 1 has three spaced-apart runners 60 and a plurality of transverse members 62 that are spaced-apart along the longitudinal length of the base and attached at distal ends to the runners. A pair of tube alignment blocks 66 attach on an upper surface of the transverse members 62*a* at the distal ends of the base 14. The tube alignment blocks 66 are spaced inwardly from a respective side edge 68 and an end edge 70 of the transverse members 62*a*. A tube alignment member 72 attaches on each opposing side of the base 14 to a medial pair 62*b* of the transverse members 62. The tube alignment members 72 are spaced inwardly of a respective side edge 74 of the base 14. The runners 60, the transverse members 62 and the alignment blocks 66, 72 attach together with nails. In an alternate embodiment (not illustrated) each of the runners 60 comprises a plurality of short length members aligned axially and spaced-apart end-to-end to define notches, openings, or gaps for insertion of forks of a forklift truck for picking up the base 14 and the heavy article held in the crate 10 from the side. This embodiment provides "four way" entry of the forks from either side or either end. The base 14 illustrated in FIG. 1 is a "two way" end entry for forklifting.

FIG. 1 also shows the top frame 16 exploded from the hinged-corners unitary wood cleated body 12. The top frame 16 has a pair of spaced-apart elongate runners 80 joined together by a pair of cross slats 82 at the distal ends 84, 86 of the top frame 16. A tube alignment member 88 attaches to a lower surface of the respective cross slats 82 and spaced inwardly from an edge 90. For illustration purposes, the cross slat 82 at the distal end 84 is partially cut-away to show the tube alignment member 88. The illustrated embodiment has a pair of spaced-apart cross slats 92 disposed transverse to the runners 80 intermediate the distal ends 84, 86. The distal ends of the cross slats 82 and 92 extend outwardly from the runners 80 to define overhanging recesses 96 on the sides of the top frame 16. The cross slats 82 likewise extend outwardly from the ends of the runners 80 to define overhanging recesses 98. The cross slats 82, 92, the tube alignment members 88, and the runners 80, connect together with nails.

The crate 10 provides a rigid, strong container for holding heavy articles for storage, shipping, and handling. The side frames 22 and the end frames 24 are assembled, preferably using a jig (not illustrated) to hold the elongate wood cleat rails 22 and the slats 32 in position for nailing together at overlapping distal ends. The cross members 36 are attached to the frames 22, 24.

Figure 2:
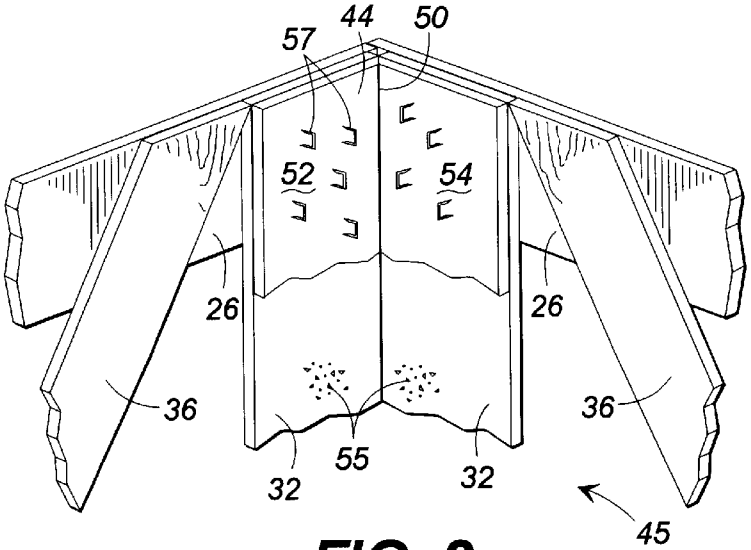
FIG. 2 is a perspective detailed view of a portion of a hinged-corner in the wood cleated crate body illustrated in FIG. 1.

The side and end frames 22, 24 are held adjacent in alternating sequence whereby one of the slats 32 in the side frame 22 is adjacent one of the slats 32 in the end frame 24, for assembling the tubular body 12. The hinge plates 44 are attached with the glue 55 and the staples 57 that extend through the panels 52, 54 into the respective slats 32, as shown in FIG. 2. The hinge plates 44 are oriented with the score 50 aligned between the slats 32 in the adjacent side and end frames 22, 24.

After each hinge plate 44 is attached, the interconnected side and end frames 22, 24 are then folded along the scores 50. This brings the first distal end 18 into adjacent alignment with the second distal end 20. This permits interconnecting the hinge plate 44*a* at the second distal end 20 to the slat 32*a* on the end frame 22*a* at the first distal end 18, with the glue 55 and the staples 57. This interconnection completes the formation of the tubular hinged-corners wood cleated body 12.

The tubular body 12 then has the desirable characteristics of a regular corrugated paperboard carton. The scored hinge plates 44 allow the hinged body 12 to fold substantially flat for knock-down storage and shipping prior to use for containing a heavy article. The body 12 readily unfolds into a volumed body as shown in FIG. 1 for enclosing a heavy article held on the base 14 and for receiving the top frame 16. The hinge plates 44 define squared-corners 45.

The wood cleated crate 10 is used by first attaching the heavy article to the base 14. As may be appreciated, the particular structural features of the base 14 may be varied by one of ordinary skill in the art in order that the heavy article is appropriately and adequately supported thereon.

The body 12 is unfolded along the scores 50 to define the open tubular volumed body with squared-corners for attachment to the base 14. The tubular body 12 eliminates the need to form a final joint seam during the packaging operations at the users' facility. The rails 26 on the lower edges 28 of the end frames 22 abut against the tube alignment blocks 66. The rails 26 on the lower edges 28 of the side frames 24 abut against the tube alignment members 72. In a preferred embodiment, the gap between the tube alignment blocks 66 and the edges 68, 70 and the gap between the exterior face of the tube alignment members 72 and the side edge 74 are of a width for receiving the rails 26 without overhang, so that the body 12 is received squarely on the base 14.

The top frame 16 is then received onto the upper edge 30 of the body 12. The overlapping portions of the cross slats 82 and 92 contact the upper edges 30 of the rails 26 of the side and end frames 22, 24. The rails 26 are received in the overhanging recesses 96 and 98. The rails 26 contact the runners 80, so that the top frame 16 is squarely received on the body 12.

The base 14 and the top frame 16 are then secured to the body 12 by driving a plurality of nails or staples through the rails 26 into the respective tube alignment blocks 66 and members 72, 88, and the runners 80. The blocks 66, members 72, 88, and runners 80 thereby function as stapling headers for rapid and easy engagement of the tubular body 12 to the base 14 and the top frame 16.

The crate 10 of the present invention provides significant improvements over conventional cleated crates, including easier, less labor intensive packaging of heavy articles. The hinged corners 45 provide racking resistance for stacking multiple units and improved tensile strength characteristics. The top frame 16 communicates top load forces through the vertical slats 32 to the base 14. The interconnected base 14, body 12, and top frame 16, cooperatively resist twisting and separation of the crate 10 during shipping, storage, and handling. Materials in the preferred embodiments permit ready recycling or reuse of the component parts in the crate. For example, the slats, rails, and hinge plate components are readily ground up for processing, such as for boiler fuel. Further, the readily collapsed body 12 provides efficient use of storage and shipping spaces before use for packaging heavy goods.

The principles, preferred embodiments and modes of operation of the present invention have been described in the foregoing specification. The invention is not to be construed as limited to the particular forms disclosed because these are regarded as illustrative, rather than restrictive. Moreover, variations and changes may be made by those skilled in the art without departing from the spirit of the invention as described by the following claims.

What is claimed is:

1. A hinged-corners unitary collapsible wood cleated crate for packaging heavy goods, comprising:

a unitary wood cleated tubular body comprising a pair of opposing side frames and a pair of opposing end frames, each said side frame and end frame comprising a pair of parallel spaced-apart horizontal rails which define a lower edge and an upper edge of said body, a pair of parallel spaced-apart vertical slats, said rails and said slats joined rigidly together at respective overlapping aligned distal ends, and at least one diagonal cross-member extending at an oblique angle between and attached to the pair of horizontal rails, said side frames and said end frames joined together in alternating spaced-apart sequence by a plurality of hinge plates that each interconnects one of the pair of vertical slats in one of the side frames with one of the pair of vertical slats in an adjacent end frame;

each of said hinge plates defined by a planar sheet of a weather-resistant material, said sheet having a longitudinal axis and a score defined parallel thereto which defines a pair of panels each of which rigidly attaches to a respective one of the vertical slats in the adjacent side and end frames, the hinge plates extending substantially the length of the vertical slats between the pair of horizontal rails, whereby the pairs of said side frames and said end frames, being joined together by said hinge plates, forms a unitary wood cleated crate body that foldingly collapses on the scores to a substantially flat knock-down position for storage and shipping from a manufacturer thereof to a user for packaging heavy goods therein upon unfolding along said scores to define a volumed unitary crate body for engaging a base containing a heavy good to be packaged therein.

2. The hinged-corners unitary collapsible wood cleated crate as recited in claim 1, wherein said sheet material comprises solid fibre paperboard.

3. The hinged-corners unitary collapsible wood cleated crate as recited in claim 1, wherein said sheet material comprises a plastic corrugated sheet material.

* * * * *